US006729392B2

(12) United States Patent
DeBerry et al.

(10) Patent No.: US 6,729,392 B2
(45) Date of Patent: May 4, 2004

(54) TUBING HANGER WITH BALL VALVE IN THE ANNULUS BORE

(75) Inventors: Blake DeBerry, Singapore (SG); Larry Reimert, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 42 days.

(21) Appl. No.: 10/071,650

(22) Filed: Feb. 8, 2002

(65) Prior Publication Data

US 2003/0150620 A1 Aug. 14, 2003

(51) Int. Cl.[7] ..... E21B 19/00; E21B 19/02

(52) U.S. Cl. ..... 166/75.14; 166/95.1

(58) Field of Search ..... 166/75.14, 86.2, 166/87.1, 88.1, 95.1, 97.1, 348, 368

(56) References Cited

U.S. PATENT DOCUMENTS

| | | | | |
|---|---|---|---|---|
| 3,601,190 A | | 5/1969 | Mott | 166/85 |
| 4,807,700 A | | 2/1989 | Wilkins | 166/86 |
| 4,867,243 A | * | 9/1989 | Garner et al. | 166/77.4 |
| 5,143,158 A | | 9/1992 | Watkins et al. | 166/344 |
| 5,305,230 A | | 4/1994 | Matsumoto et al. | 364/495 |
| 5,535,826 A | | 7/1996 | Brown et al. | 166/363 |
| 5,687,794 A | | 11/1997 | Watkins et al. | 166/363 |
| 5,706,893 A | | 1/1998 | Morgan | 166/86.1 |
| 5,769,162 A | | 6/1998 | Bartlett et al. | 166/87.1 |
| 5,865,246 A | | 2/1999 | Brown | 166/95.1 |
| 5,873,415 A | | 2/1999 | Edwards | 166/344 |
| 5,992,527 A | | 11/1999 | Garnham et al. | 166/379 |
| 6,062,314 A | | 5/2000 | Nobileau | 166/368 |
| 6,109,353 A | | 8/2000 | Edwards et al. | 166/367 |
| 6,176,316 B1 | | 1/2001 | Hart | 166/368 |
| 6,227,301 B1 | | 5/2001 | Edwards et al. | 166/344 |
| 2002/0153143 A1 | | 10/2002 | Compton et al. | |

FOREIGN PATENT DOCUMENTS

| | | |
|---|---|---|
| WO | WO 03/038228 | 10/2001 |

* cited by examiner

*Primary Examiner*—David Bagnell
*Assistant Examiner*—Brian Halford
(74) *Attorney, Agent, or Firm*—Loren G. Helmreich; Browning Bushman, P.C.

(57) ABSTRACT

A tubing hanger is provided for suspending a tubing hanger from a wellhead housing. The tubing hanger body includes a production bore and an annulus bore, a valve opening inlet port, a valve closed inlet port, and a hydraulically operated ball valve to selectively open and close the annulus bore. An actuator sleeve surrounds the ball valve and is movable in response to fluid pressure between the open and closed positions.

16 Claims, 7 Drawing Sheets

TUBING HANGER WITH BALL VALVE IN THE ANNULUS BORE

FIELD OF THE INVENTION

The present invention relates to a wellhead assembly including tubing hanger and, more specifically, to positioning a ball valve in fluid communication with the annulus bore of a tubing hanger of an oil or gas well production system. The improved tubing hanger may be used in surface or subsea trees, and may be used in either conventional or horizontal trees.

BACKGROUND OF THE INVENTION

A conventional tubing hanger in a wellhead assembly has a vertical production bore and at least one generally vertical annulus bore which is in communication with the tubing annulus between the production tubing and the production casing. The lower end of the annulus bore thus exits the bottom of the tubing hanger, and in a conventional tree or a single-bore tree the upper end of the annulus bore typically exits the top of the tubing hanger for communication with the tree. In a horizontal tree, the well annulus is typically in communication with a lateral bore in the tree housing, which in turn may be connected by a crossover line to a crossover valve, thereby allowing annulus fluids to flow laterally out of the tubing hanger and through the tree body.

The annulus bore in subsea trees has conventionally been opened and closed by a gate valve. Gate valves require a large area for installation and operation. Because room in the tubing hanger must also be provided for various penetrations, such as control lines, gate valves in tubing hangers are not preferred. U.S. Pat. No. 5,706,893 discloses a gate valve which requires a complicated operator or actuator which relies upon gears, which are not suitable for use in subsea wells. A gear-type actuator for a rotary shear seal valve in the annulus line of the tubing hanger is prone to clogging with debris, thereby further reducing reliability. U.S. Pat. No. 4,807,700 disclose another gear-operated ball valve in the annulus of a tubing hanger.

U.S. Pat. No. 6,176,316 discloses a ball valve in the producing fluid bore of a tubing hanger with an external operator. External actuators cannot be retrieved for repair or replacement with the tubing hanger, and the size of the operators add significant length and cost to the tree system.

U.S. Pat. No. 5,769,162 discloses a sleeve valve in the annulus bore of a tubular hanger. Sleeve valves have a tortuous flow path which is undesirable, and seals in a sleeve valve are prone to getting damaged as they pass over the lateral entry port in the valve. U.S. Pat. No. 5,305,230 discloses an annulus slide valve in a tubing hanger. U.S. Pat. Nos. 5,143,158 and 5,687,794 disclose annulus lines in a tubing hanger.

U.S. Pat. No. 5,873,415 discloses a ball valve within the annulus line of a subsea test tree. The ball valve is biased closed by a spring, so that when hydraulic pressure is removed, the valve will automatically close. When a valve is provided in a tubing hanger, the valve should be a "fail-as-is" type, so that the valve retains the position in which it was last moved, whether opened or closed. Once moved to that position, fluid pressure may be removed, and the valve will remain in the last moved position. U.S. Pat. No. 6,227,301 discloses two ball valves in series in a subsea test tree each in fluid communication with a production string, with another valve in one annulus bore operated by an umbilical from the surface, and a cable to power an electrical submersible pump in another annulus bore.

U.S. Pat. No. 3,601,190 discloses a ball valve in the production string of a hanger. The valve is accordingly for production control, rather than for annulus control. A sleeve is provided only partially around the ball, and the ball moves up and down axially when it is opened and closed, which may cause pressure build up when the ball is actuated. The ball valve is spring return closed. Internal producing fluid pressure may actuate the ball valve between the opened and closed positions.

U.S. Pat. No. 6,109,353 discloses a ball valve in a test tree or riser joint which is spring return closed. U.S. Pat. Nos. 5,992,527, 5,865,246 and 5,535,826 also disclose a ball valve in a tree. U.S. Pat. No. 6,062,314 discloses a ball valve.

The disadvantages of the prior art are overcome by the present invention, and an improved tubing hanger is hereinafter disclosed with a ball valve positioned in communication with the annulus bore in the tubing hanger.

SUMMARY OF THE INVENTION

A tubing hanger is disclosed for use in an oil or gas well for suspending tubing weight from a wellhead housing. The tubing hanger includes a production bore, at least one annulus bore, a valve open inlet port and a valve closed inlet port. The annulus bore is in fluid communication with an annulus about the tubing string. A ball valve preferably may have a generally straight through bore with an axis generally aligned with the axis of the annular bore. An actuator sleeve surrounds the ball and acts as a hydraulic piston. The actuator sleeve is moveable axially only in response to the application of hydraulic pressure to the valve open or valve closed inlet ports, which are isolated from the annulus and production bores. Axial movement of the actuator sleeve causes the ball to rotate from an open position to a closed position. The release of hydraulic pressure causes the actuator sleeve and the ball valve to remain in last position to which it was moved. The ball valve in the annulus bore may be moved to a closed position to shut off flow during setting of the tubing hanger, and may subsequently be opened for testing and circulation.

It is an object of the present invention to provide an improved tubing hanger with a ball valve in communication with the annulus bore for sealing the bore when the ball valve is closed, and for opening the bore for testing and circulation operations. A related object of the invention is to provide a wellhead assembly including the improved tubing hanger.

It is a feature of the present invention that the wellhead assembly with the tubing hanger having a ball valve in the annulus bore may be used in a conventional or single-bore tree, wherein flow lines from the ball valve pass upwards to the top of the tubing hanger. It is a further feature of the invention that the wellhead assembly with the tubing hanger having a ball valve in the annulus bore may be used in a horizontal tree wherein the tree housing includes a lateral port in fluid communication with the production bore. The ball valve may be closed when a tubing hanger running tool and/or a work-over riser is in place.

A significant feature of the tubing hanger with a ball valve in the annulus bore is that the ball valve and its actuation mechanism are positioned inside the primary pressure barrier, i.e., inside the seal, such as the DX gasket, on the wellhead or the tree. Since the ball valve is positioned within the tubing hanger, it is immune to being knocked off, e.g., due to dropped objects. The ball valve requires much less room than a gate valve, thus leaving more room in the tubing hanger for penetrators and control lines. The ball valve actuating mechanism is relatively simple and highly reliable.

Another significant feature of a tubing hanger according to the present invention is that the actuator sleeve seals fluid pressure in the annulus bore, and accordingly housings and seals external of the actuator sleeve are not required to close off the annulus bore. An upper seal may be provided along the actuator sleeve above the ball valve for sealing with the tubing hanger body, and a lower seal provided below the ball valve also seals with the tubing hanger body while the actuator sleeve moves between opened and closed positions.

It is a further feature of the invention that a production control valve external of the tubing hanger body be provided for controlling fluid flow in the production bore.

Another significant feature of the invention is that the ball valve is preferably positioned within the tubing hanger body. The ball valve is normally closed, and is conventionally opened for a work-over or crossover operation. The ball valve is moveable between opened and closed positions only in response to fluid pressure from the valve open inlet port or the valve closed inlet port. The ball valve is preferably rotated between opened and closed positions about an axis stationary with respect to the tubing hanger.

Another significant feature of the present invention is that the ball valve may form a straight-through flow path when the valve is open. By providing a ball valve with a straight-through flow path, erosion on the valve is minimized when high velocity fluids pass through the valve.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
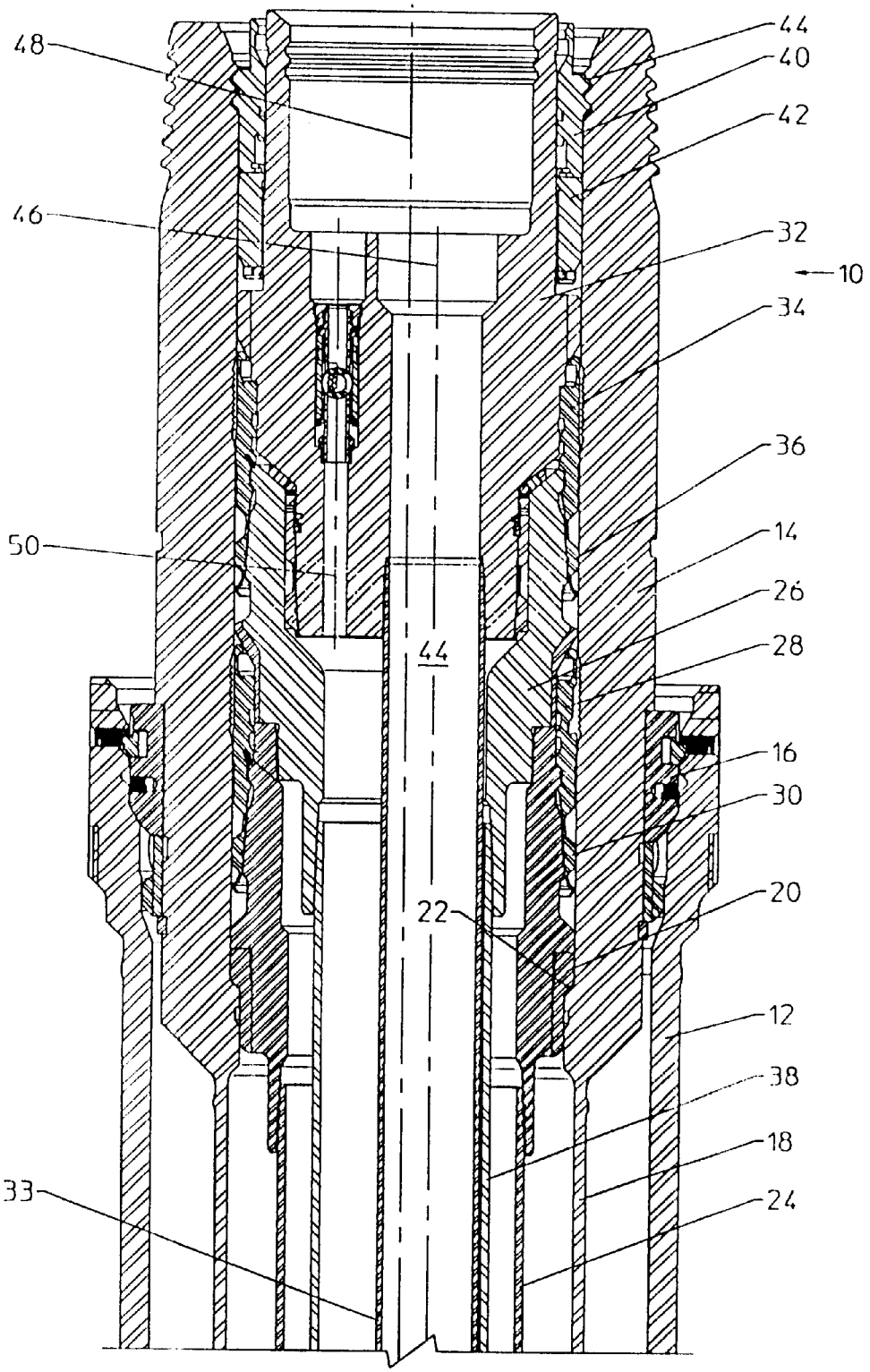
FIG. 1 is a simplified view of one embodiment of a wellhead housing according to the present invention, illustrating a first or lower casing hanger, a production casing hanger, and a tubing hanger each supporting the exterior casing, the production casing, and the tubing, respectively.

FIG. 1 depicts one embodiment of a wellhead assembly 10 according to the present invention supporting a tubing hanger therein. The assembly 10 as shown includes an outer conductor 12 supporting a wellhead housing 14 by a conventional connector 16. The wellhead housing 14 supports an outer casing 18. A lower casing hanger 20 is shown landed on support surface 22 of the wellhead housing 14, with an outer casing 24 extending downward from the casing hanger 20. The upper casing hanger 26 is shown landed on the lower casing hanger 20. Pusher sleeve 28 is pressed downward by a setting tool (not shown) so that seal 30 is in reliable sealing engagement with the wellhead housing 14. Wherein the tubing hanger body 32 is shown landed on the upper casing hanger 26, the pusher sleeve 34 has previously forced seal 36 into sealing engagement with the wellhead housing 14. The upper casing hanger 26 supports the inner casing 38, which is commonly referred to as the production casing, and the tubing hanger 32 supports the tubing string 33 positioned within the production casing 38. A locking sub 42 is threadably connected to the tubing hanger body 32 and lockdown member 40 cooperates with internal grooves 44 on the wellhead housing 14 to reliably secure the tubing hanger within the wellhead housing.

The tubing hanger body 32 thus includes a production bore 44 which has a central axis 46 spaced from the central axis 48 of the wellhead housing 14. The wellhead housing 32 also includes an annulus bore 50 in the tubing hanger body 32 and fluidly isolated from the production bore 44 by the tubing string 33. The annulus bore 50 is thus in fluid communication with the annulus between the production casing 38 and the tubing 33, while the production bore 44 is in fluid communication with the tubing string 33. Preferably the axis 46 of the production bore is aligned with the axis of the upper end of the tubing string 33.

Figure 2:
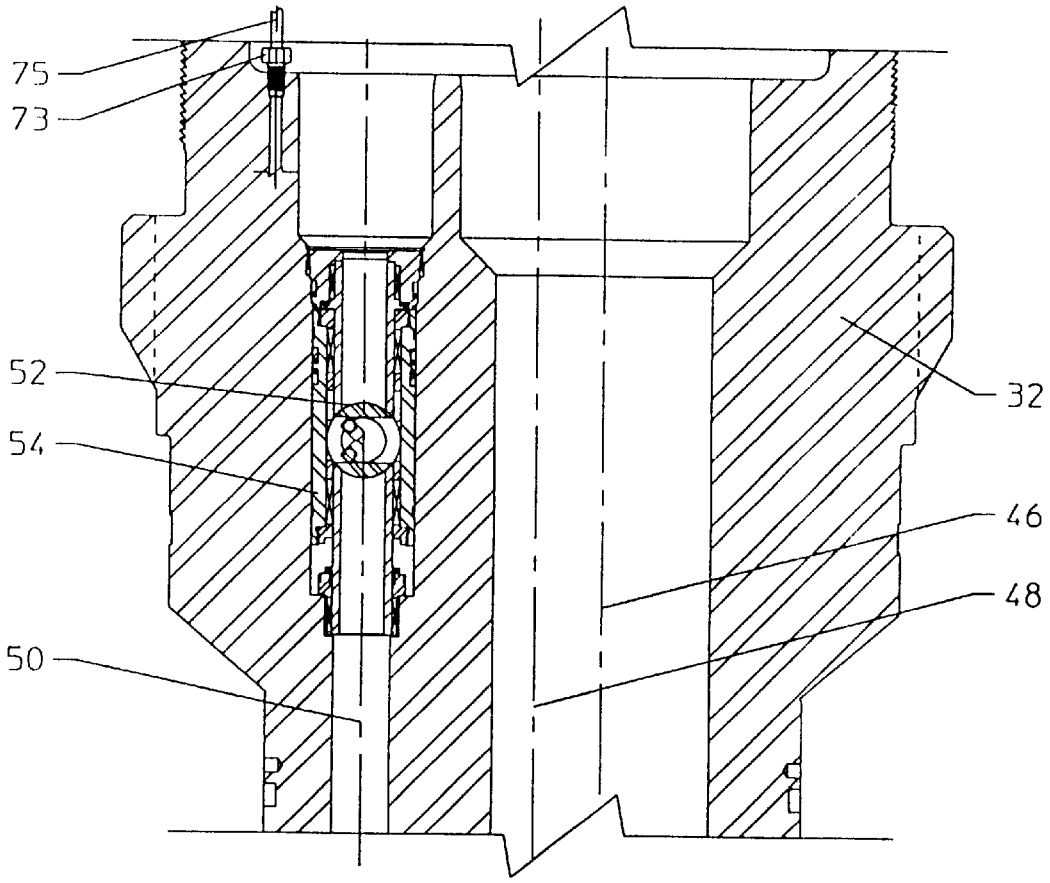
FIG. 2 is an enlarged view of a portion of the tubing hanger shown in FIG. 1.
Figure 3:
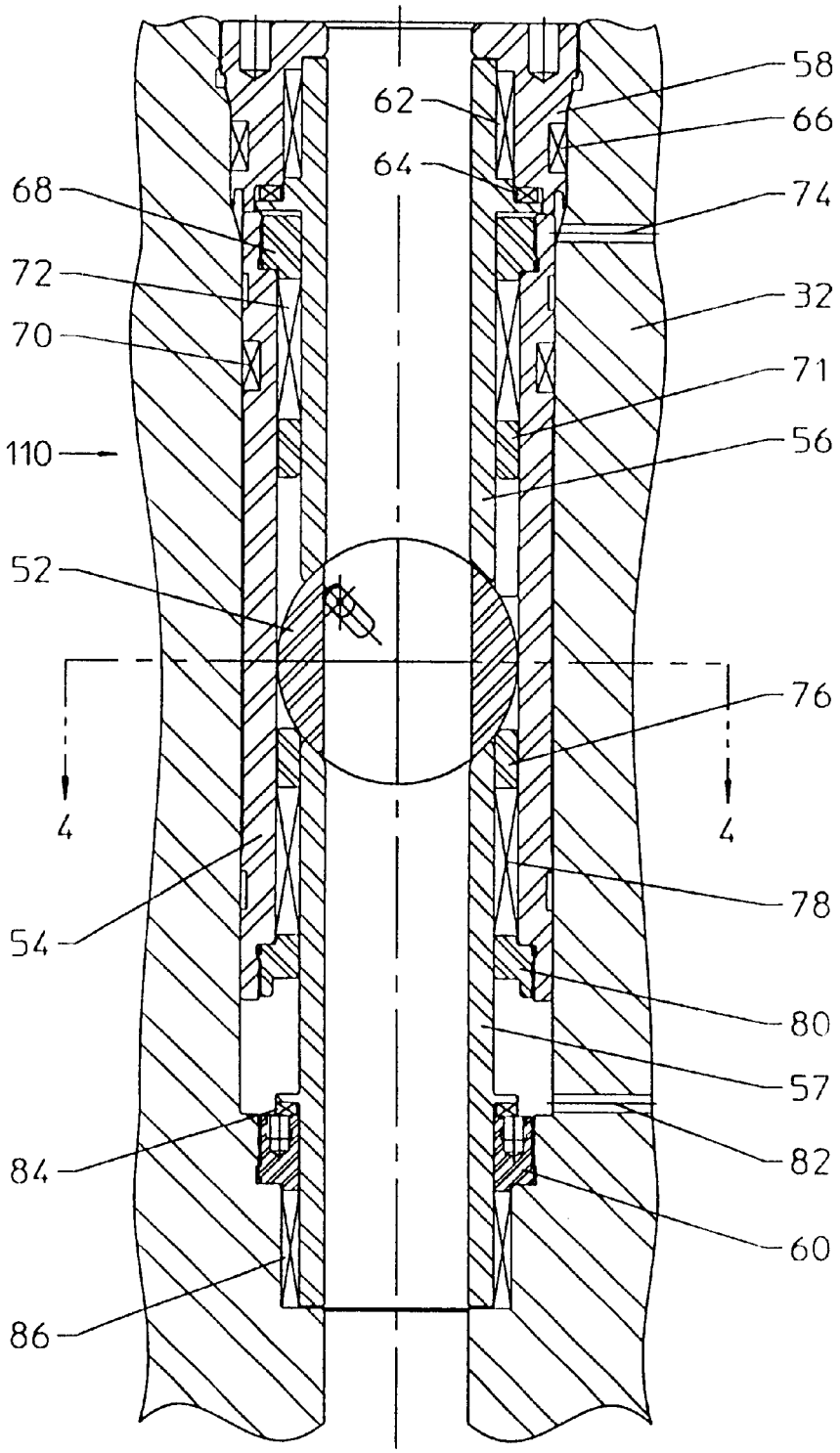
FIGS. 3 and 5 depict one embodiment of the ball valve and actuating mechanism of the present invention in the opened and closed positions, respectively.
Figure 5:
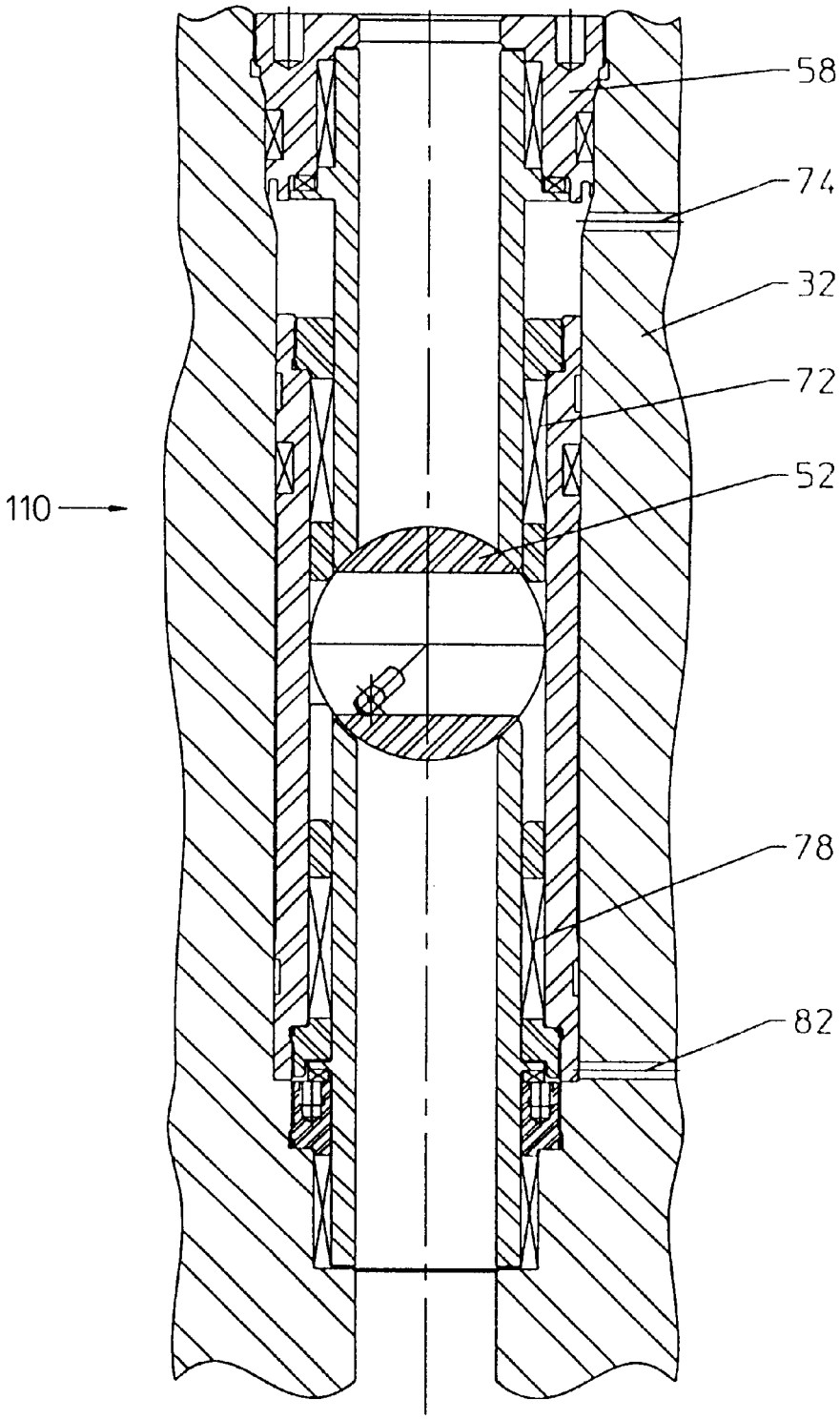

FIG. 2 shows in greater detail the ball valve 52 in fluid communication with the annulus bore 50 in the tubing hanger body 32, with a ball valve being positioned within an actuator sleeve 54 which surrounds the ball valve and is connected thereto by a linkage mechanism. As shown in FIGS. 3 and 5, a valve open inlet port 82 in the tubing hanger body 32 is in fluid communication with one end, in this embodiment the lower end of the actuator sleeve 54, while a similar port 74 is in communication with the upper end of the actuator sleeve. The actuator sleeve may thus be moved in response to fluid pressure in the valve open inlet port 82 to open the ball valve, and is thereafter moveable in response to fluid pressure in the valve closed port 74 to close the ball valve 52. The ball valve 52 is shown in the open position in FIG. 3 and in the closed position in FIG. 5.

Hydraulic fluid from a source, such as a control system, may enter the tree head in various locations, such as a lateral opening which cooperates with a fluid line connector which to mate with one of the inlet ports in the tubing hanger. FIG. 2 shows an exemplary connector 73 connecting flow line 75 to the body 32. The ball valve may be opened or closed at any time during production, such as for crossover operation or a work over operation. Where the hydraulic lines enter the tree head, fluid pressure may first pass through a block or needle valve which acts as a secondary pressure barrier to prevent any product flow in the tubing or the casing from unintentionally communicating with the hydraulic actuator sleeve 54.

Referring again to FIG. 3, the ball valve is physically positioned within the tubing hanger body 32 by upper seat sleeve 56, so that the ball 52 rotates about an axis fixed with respect to the tubing hanger body and with respect to the seat sleeve 56 when moving from the opened to the closed position. A top end cap 58 may be conventionally secured to the body 32, with seal 62 sealing with the seat sleeve 56, and seal 66 sealing with the tubing hanger body 32. Energizing spring 64 exerts a downward force on sleeve 56 which tends to seal the ball against the seat formed at the upper end of the lower seat sleeve 57. As shown in FIG. 3, the upper seat sleeve 56 has a sealing diameter with end can 58, and thus with the tubing hanger which is sealed with the end cap, which is greater than the sealing diameter between the upper seat sleeve 56 and the ball 52. This feature enables fluid pressure within the bore from above the tubing hanger to be used to test the sealing integrity between the upper seat sleeve and the ball, which is the same seal which controls fluid pressure from below when the ball is closed. Actuator sleeve 54 thus reciprocates within the tubing hanger body from the ball closed position as shown in FIG. 5 to the ball open position as shown in FIG. 3 in response to fluid pressure in the valve open port 82. Upper ring 68, seal 72, seal 70, and retainer ring 71 thus move as an assembly with the actuator sleeve 54 between the FIG. 3 and FIG. 5 positions, while simultaneously moving the retainer ring 76, seal 78, and lower ring 80. The lower end of seat sleeve 57 is secured in place to the body 32 by retaining ring 60, and is sealed to the body by seals 86. Seal 78 seals between the lower seat sleeve 57 and actuator sleeve 54, which is sealed to the body 32, and energizing spring 84 biases seat sleeve 57 upward so that the ball seals against the lower end of upper seat sleeve 56. Fluid pressure in the port 82, and the absence of pressure in the port 74, thus moves the ball 52 to the open position as shown in FIG. 3, and the ball will stay in that position until the actuator sleeve is moved in response to pressure in the valve closed port 74, which will then shift the actuator sleeve downward to the position as shown in FIG. 5, thereby closing the ball 52. The ball will then stay closed until it is opened by providing pressure to the valve open port 82.

Figure 4:
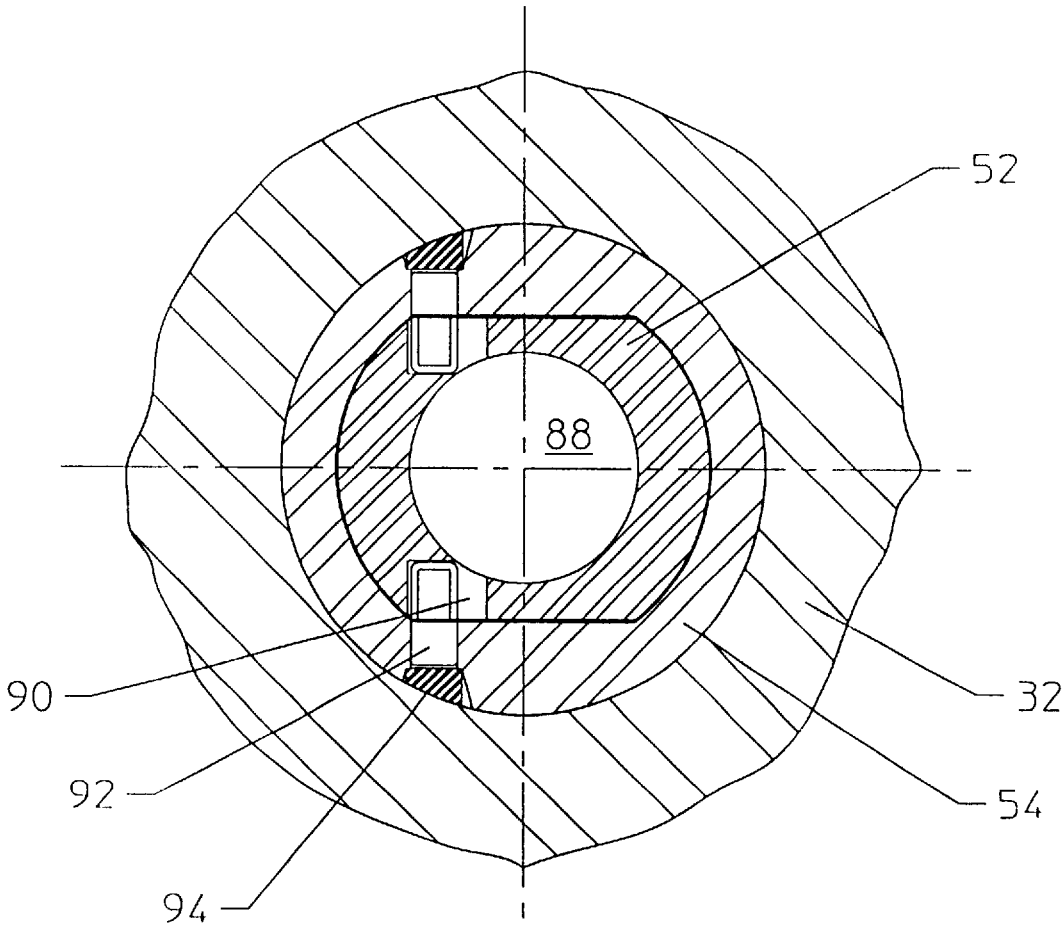
FIG. 4 is a cross-sectional view of the ball valve in FIG. 3.

Referring to FIG. 4, the ball 52 is shown positioned within the actuator sleeve 54, which in turn is positioned within the tubing hanger body 32. A pair of slots 90 in the ball 52 each receive a portion of the respective linkage mechanism, which may be a linkage pin 92 secured to the actuator sleeve 54 and movable within the slot 90 in the ball. An end cap, weld plug, or other closure member 94 may be used to prevent fluid within the bore 88 of the ball 52 from acting on the upper or lower ends of the actuator sleeve 54.

Figure 6:
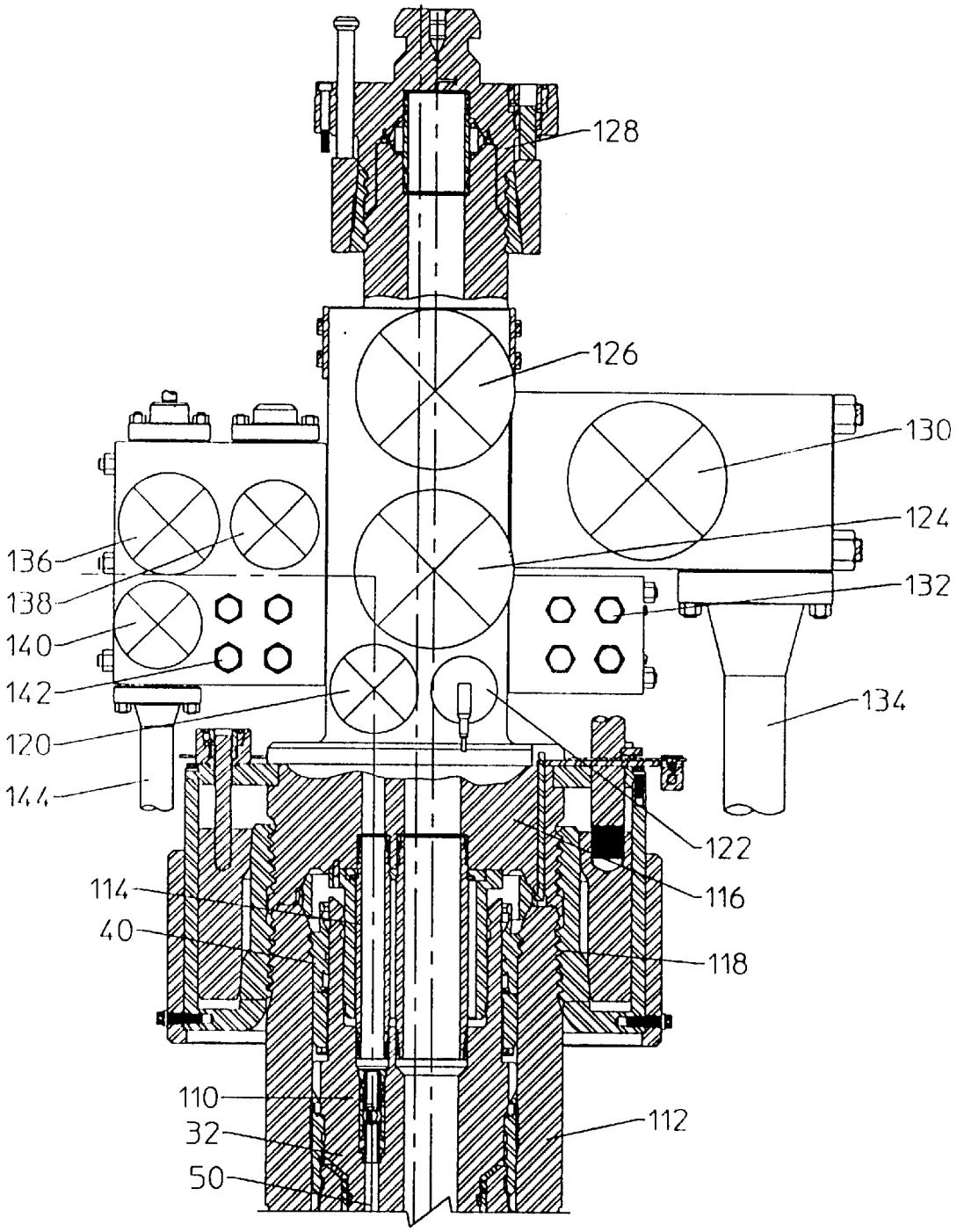
FIG. 6 depicts the wellhead assembly partially shown in FIG. 1 with a tree mounted thereon, the tree including a production bore in communication with the production bore in the tubing hanger, and an annulus bore in communication with the annulus bore in the tubing hanger.

FIG. 6 discloses in further detail a suitable wellhead assembly which includes a ball valve and actuator assembly 110 as discussed above within a tubing hanger body 32. Tubing hanger body 32 includes the annulus bore 50 as previously discussed. The ball valve may thus be opened and closed to selectively control fluid communication between the annulus bore and the tree. The assembly shown in FIG. 6 includes a wellhead housing 112 secured by a conventional connector assembly 118 to the tree housing 116. The conductor tube 114 provides fluid communication between the upper end of the ball valve and actuator assembly 110 and an annulus bore internal of the tree 116. Those skilled in the art will appreciate that the tree as shown in FIG. 6 is exemplary of a suitable conventional or single-bore tree, and that various configurations for a tree may be used with the tubing hanger having a ball valve according to the present invention.

In the FIG. 6 embodiment, the hydraulically operated annulus master valve 120 controls fluid communication within the annulus bore in the tree, and downhole transducers 122 are responsive to downhole temperature and pressure. A hydraulically operated production master valve 124 in the tree controls fluid flow through the production bore, with valve 126 typically being a production swab valve. The tree may also include a hydraulically operated production wing valve 130, with production line 134 extending from the tree. Chemical injection valves, annulus valves, and control line valves 132 may also be provided, with similar valves 142 on the opposing side of the tree. Crossover valve 138, annulus valve 136, and wing valve 140 may be used for controlling fluid flow to the annulus line 144. A conventional tree cap 128 is provided or the upper end of the tree.

Figure 7:
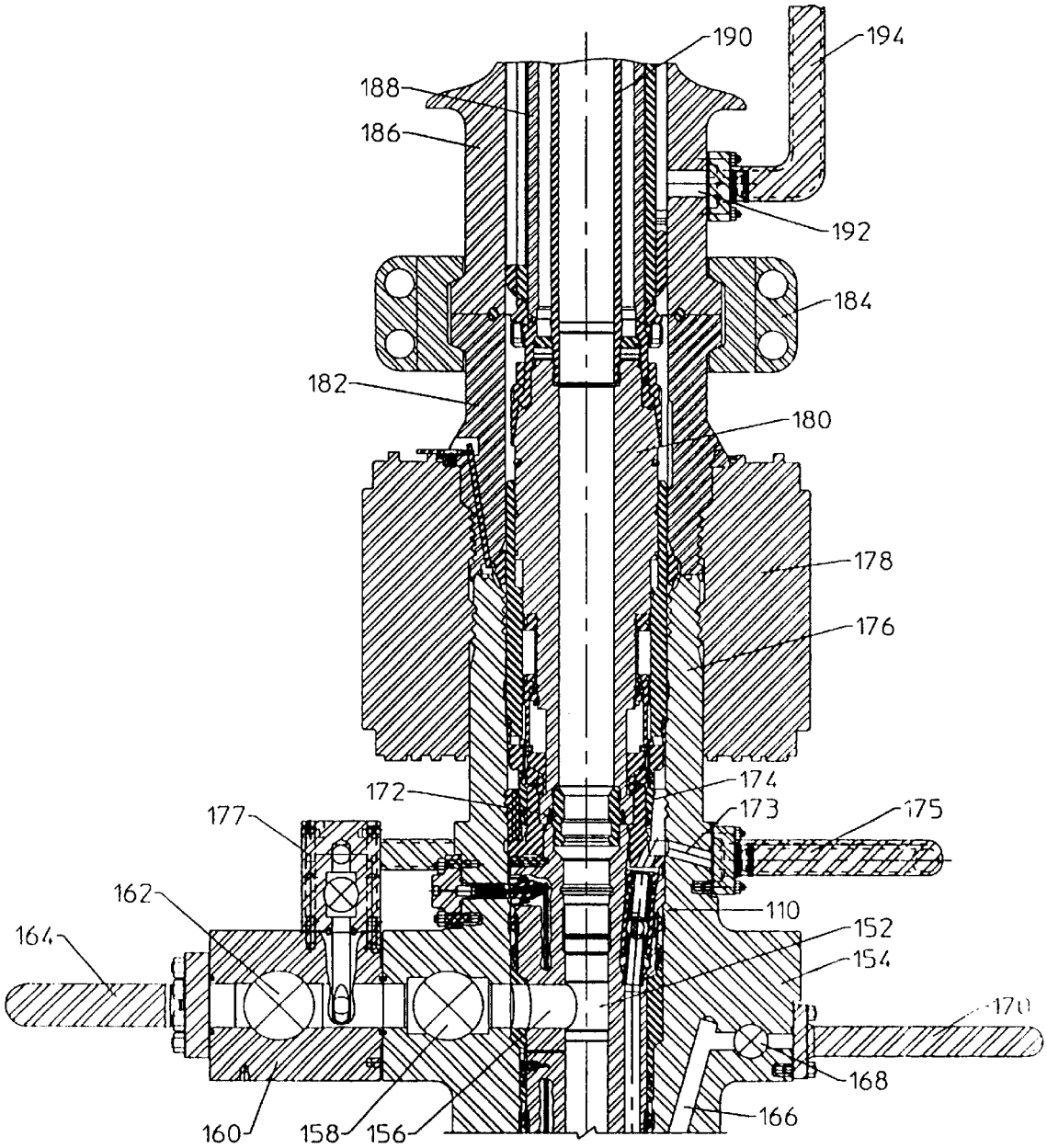
FIG. 7 depicts an alternate wellhead assembly, with a tubing hanger in a wellhead housing having a lateral port in communication with the production bore in the tubing hanger, an annulus valve, and a crossover line in communication with a port in the wall of the wellhead housing, which in turn is in communication with the annulus bore in the tubing hanger.

FIG. 7 shows the tubing hanger with the ball valve and actuator assembly 110 of the present invention, a tubing hanger 152 for a horizontal wellhead assembly. Tubing hanger body 152 thus includes a lateral bore 156 which is in communication with a similar bore in the wellhead housing 154, with that bore including a production control valve 158. An annulus line 166 may also be provided in the wellhead housing 154, with annulus valve 168 selectively controlling fluid flow to the annulus line connector 170. Another production valve 162 may be provided in wing block 160, with a passageway in the wing block communicating with the lateral bore in the wellhead assembly. Connector line 164 may thus receive a suitable production control line. The upper end of the ball and actuator sub assembly 110 is thus open to fluid communication in lateral port 173 in the wellhead housing, which is in fluid communication with a crossover connector 175 for connection to a suitable crossover line. Conventional crossover valve 177 may thus receive fluid that flows through the ball valve and actuator assembly 110 through the lateral port 173, and may pass through the crossover valve 177 to a location between the valves 162 and 158. A tubing hanger sleeve 172 is shown in the FIG. 7 embodiment. The upper end 176 of the horizontal tree body 154 may be connected to a BOP stack 186 by connector 178, adaptor 182 and clamp 184. Lateral port 192 in the BOP stack 186 is thus fluidly connected to a conventional choke and kill line 194. Tubing string 190 extends upward from the BOP stack, and running string 188 may be used to position the tubing hanger running tool 180 as shown in FIG. 7.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A tubing hanger for suspending a tubing string from a wellhead housing, comprising:

a tubing hanger body including a production bore, an annulus bore fluidly isolated from the production bore and in fluid communication with an annulus about the tubing string, a valve open inlet port, and a valve closed inlet port, each of the inlet ports being fluidly isolated from both the production bore and the annulus bore and located at least partially within the tubing hanger body;

a hydraulically actuated ball valve located in the annulus bore in the tubing hanger body and including a ball rotatable between opened and closed positions about an axis substantially stationary with respect to the tubing hanger body to selectively open and close the annulus bore;

a fluid impermeable actuator sleeve surrounding and radially outward of an outer surface of the ball and connected to the ball, the actuator sleeve being moveable in response to fluid pressure in the valve open inlet port to move the ball to open, and moveable in response to fluid pressure in the valve closed inlet port to move the ball closed;

an upper seat sleeve and a lower seat sleeve each substantially axially stationary with respect to the tubing hanger body and radially within the actuator sleeve;

an upper seat actuator seal and a lower seat actuator seal each for sealing between a respective seat sleeve and the actuator sleeves; and the actuator sleeve being fluid impermeable between the upper seat actuator seal and the lower seat actuator seal to retain fluid pressure within the annulus bore and prevent fluid pressure in the annulus bore from moving the actuator sleeve.

2. The tubing hanger as defined in claim 1, further comprising:

a production control valve external of the tubing hanger body for controlling flow in the production bore.

3. The tubing hanger as defined in claim 1, wherein the ball valve is normally closed, and is opened for one of a work-over operation and a crossover operation.

4. The tubing hanger as defined in claim 1, wherein the ball valve is moveable between opened and closed positions only in response to fluid pressure in one of the valve open inlet port and the valve closed inlet port.

5. The tubing hanger as defined in claim 1, wherein the ball includes a straight-through flow bore with an axis substantially aligned with an axis of the annulus bore when the ball valve is in the open position.

6. The tubing hanger as defined in claim 1, wherein each of the valve closed inlet port and the valve open inlet port include a connector fluidly connecting a flow line to the tubing hanger body.

7. The tubing hanger as defined in claim 1, further comprising:

an energizing spring for exerting a downward force on the upper seat sleeve to press the seat sleeve against the ball.

8. A wellhead assembly including a housing for landing a tubing hanger therein to support a tubing string in a well, the tubing string having a tubing bore and a tubing annulus between the tubing string and a casing, the wellhead comprising:

a tubing hanger body including a production bore in fluid communication with the tubing bore, and a fluidly isolated annulus bore in fluid communication with the tubing annulus, a valve open inlet port, and a valve closed inlet port, each inlet port located at least partially within the tubing hanger body;

a valve external of the tubing hanger body for controlling fluid flow in the production bore;

a hydraulically actuated ball valve within the annulus bore of the tubing hanger body and including a ball rotatable between opened and closed positions about an axis substantially stationary with respect to the tubing hanger body and selectively moveable to open and close the annulus bore;

an actuator sleeve generally surrounding and radially outward of an outer surface of the ball and connected to the ball, the actuator sleeve being moveable in response to fluid pressure in the valve open inlet port to move the ball to the open position, and moveable in response to fluid pressure in the valve closed inlet port to move the ball to the closed position; and an upper seat sleeve and a lower seat sleeve each substantially stationary axially with respect to the tubing hanger body; and the upper seat sleeve having a sealing diameter with the tubing hanger body greater than the sealing diameter between the upper seat sleeve and the ball; and a seal for sealing between the tubing hanger body and the actuator sleeve to fluidly isolate the valve open inlet port from the valve closed inlet port.

9. The wellhead assembly as defined in claim 8, wherein the wellhead assembly is one of a conventional tree and a single bore tree above the tubing hanger and in communication with the annulus bore and the production bore in the tubing hanger.

10. The wellhead assembly as defined in claim 8, wherein the ball valve is normally closed, and is opened for one of a work-over operation and a crossover operation.

11. The wellhead assembly as defined in claim 8, wherein the ball valve is moveable between opened and closed positions only in response to fluid pressure in one of the valve open inlet port and the valve closed inlet port.

12. The wellhead assembly as defined in claim 8, wherein the ball includes a straight-through flow bore with an axis substantially aligned with an axis of the annulus bore when the ball valve is in the open position.

13. A wellhead assembly including a housing for landing a tubing hanger therein to support a tubing string in a well, the tubing string having a tubing bore and a tubing annulus between the tubing string and a casing, the wellhead comprising:

a tubing hanger body including a production bore in fluid communication with the tubing bore, and a fluidly isolated annulus bore in fluid communication with the tubing annulus, a valve open inlet port, and a valve closed inlet port, each inlet port located at least partially within the tubing hanger body;

a hydraulically actuated ball valve within the tubing hanger body and selectively moveable to open and close the annulus bore, the ball valve being moveable between opened and closed positions only in response to fluid pressure in one of the valve open inlet port and the valve closed inlet port, the ball valve including a ball rotated between an open position and a closed position about an axis substantially stationary with respect to the tubing hanger;

an actuator sleeve generally surrounding the ball valve and connected to the ball valve, the actuator sleeve being moveable in response to fluid pressure in the valve open inlet port to move the ball valve to the open position, and moveable in response to fluid pressure in the valve closed inlet port to move the ball valve to the closed position;

an upper seat sleeve and a lower seat sleeve each radially within the actuator sleeve for engagement with the ball;

an upper seat actuator seal and a lower seat actuator seal each for sealing between a respective seat sleeve and the actuator sleeve;

the actuator sleeve being fluid impermeable between the upper seat actuator seal and lower seat actuator seal to retain fluid pressure within the annulus bore;

the upper seat sleeve having a sealing diameter with the tubing hanger body greater than the sealing diameter between the upper seat sleeve and the ball; and a seal for sealing between the tubing hanger body and the actuator sleeve to fluidly isolate the valve open inlet port from the valve closed inlet port.

14. The wellhead assembly as defined in claim 13, wherein the ball includes a straight-through flow bore with an axis substantially aligned with an axis of the annulus bore when the ball valve is in the open position.

15. The wellhead assembly as defined in claim 13, further comprising:

a production control valve external of the tubing hanger body for controlling flow in the production bore.

16. The wellhead assembly as defined in claim 13, wherein each of the valve closed inlet port and the valve open inlet port include a connector fluidly connecting a flow line to the tubing hanger body.

* * * * *